US008087796B2

(12) United States Patent
Golembiowski

(10) Patent No.: US 8,087,796 B2
(45) Date of Patent: Jan. 3, 2012

(54) DISPLAY ASSEMBLY

(75) Inventor: Michael E. Golembiowski, Charlotte, NC (US)

(73) Assignee: Michael Golembiowski, Clyde, OH (US)

( * ) Notice: Subject to any disclaimer, the term of this patent is extended or adjusted under 35 U.S.C. 154(b) by 127 days.

(21) Appl. No.: 12/724,767

(22) Filed: Mar. 16, 2010

(65) Prior Publication Data

US 2011/0069489 A1 Mar. 24, 2011

Related U.S. Application Data

(60) Provisional application No. 61/244,481, filed on Sep. 22, 2009.

(51) Int. Cl.
*F21S 6/00* (2006.01)

(52) U.S. Cl. ..... 362/123; 362/122; 362/249.02; 362/396

(58) Field of Classification Search ..... 362/108, 362/121, 122, 123, 124, 151, 152, 225, 238, 362/249.01, 249.02, 249.11, 249.16, 314, 362/396, 457, 458, 806, 808
See application file for complete search history.

(56) References Cited

U.S. PATENT DOCUMENTS

| | | | | |
|---|---|---|---|---|
| 3,704,366 | A * | 11/1972 | Korb et al. | 362/123 |
| D275,627 | S | 9/1984 | Chan et al. | |
| 4,620,270 | A * | 10/1986 | Laakso | 362/123 |
| 4,720,773 | A * | 1/1988 | Ahroni | 362/249.01 |
| 4,812,953 | A * | 3/1989 | Ask et al. | 362/103 |
| 5,057,981 | A | 10/1991 | Bowen et al. | |
| 5,094,893 | A * | 3/1992 | Snider | 428/18 |
| D328,986 | S | 9/1992 | Lightfoot | |
| 6,017,132 | A | 1/2000 | Miller et al. | |
| 6,027,228 | A * | 2/2000 | Adams et al. | 362/249.19 |
| 6,050,701 | A | 4/2000 | Stone | |
| 6,224,231 | B1 * | 5/2001 | Personius | 362/123 |
| 6,273,584 | B1 * | 8/2001 | Wang et al. | 362/123 |
| 6,334,694 | B1 * | 1/2002 | Huang | 362/123 |
| 6,352,355 | B1 * | 3/2002 | Law | 362/253 |
| D468,558 | S | 1/2003 | Sciandra | |
| 6,634,765 | B2 | 10/2003 | Lin | |
| 6,652,927 | B1 * | 11/2003 | Chen | 428/7 |
| 6,663,921 | B1 * | 12/2003 | Quigel | 428/12 |
| 7,080,925 | B1 * | 7/2006 | Rushing | 362/249.01 |
| 7,152,998 | B2 * | 12/2006 | Rahman | 362/249.19 |
| 7,318,393 | B2 * | 1/2008 | Ayscue | 119/859 |

* cited by examiner

*Primary Examiner* — Hargobind S Sawhney

(57) ABSTRACT

An ornamental display assembly for being attached to a structure extending from a surface is provided. The ornamental display assembly includes a strap having first and second connectors on respective ends thereof and is configured to form a loop for being looped around and attached to the structure, a sleeve carried by the strap, and at least one ornamental band having a portion received in the sleeve and a portion extending from the sleeve and having a fastener on and end thereof for being fastened to the surface.

18 Claims, 6 Drawing Sheets

DISPLAY ASSEMBLY

PRIORITY CLAIM

This application claims priority to U.S. Provisional Patent Application No. 61/244,481 filed on Sep. 22, 2009, the contents of which are incorporated herein.

TECHNICAL FIELD

The presently disclosed subject matter is directed towards an ornamental display assembly, and more particularly towards an ornamental display assembly for being attached to a structure extending from a surface.

BACKGROUND

People typically enjoy placing ornamental displays in their yard for the purposes of celebration. One such example of this is the use of decorations for celebrating holidays and festivals. For displays placed within a person's yard, the decorations are usually affixed to a tree, pole, or other structure within the person's yard.

Most holiday decorations are time consuming to unpack, assemble, disassemble, and then re-pack for future use. If the decoration is in use for the first time and has just come out of the product packaging, the person's time is primarily spent attaching all of the various holiday ornaments to the tree, pole, or other structure that is going to be supporting the decoration. If the decoration is being used in successive time periods, the time required for assembly dramatically increases due to the decorations becoming tangled, lost, or broken during the process of disassembly and storage. This leads to a frustrating assembly experience and a decrease in the amount of enjoyment.

Accordingly, there remains a need for an easier, more time efficient method of placing holiday decorations outdoors that addresses the various disadvantages associated with previous devices.

SUMMARY

According to one aspect of the disclosed subject matter, an ornamental display assembly for being attached to a structure extending from a surface is provided. The ornamental display assembly includes a strap having first and second connectors on respective ends thereof and is configured to form a loop for being looped around and attached to the structure. A sleeve is carried by the strap. At least one ornamental band having a portion received in the sleeve and a portion extending from the sleeve and having a fastener on and end thereof for being fastened to the surface is provided.

According to another aspect, the strap is at least partially received within the sleeve.

According to another aspect, the sleeve has at least one aperture for allowing egress of each of the at least one ornamental bands.

According to another aspect, the at least one aperture includes at least three apertures, and wherein each of the at least three apertures is equally spaced-apart.

According to another aspect, the ornamental band is a strand of lights.

According to another aspect, the assembly includes a power cord for supplying power to the strand of lights.

According to another aspect, the sleeve has first and second ends and the power cord is received in a selected one of the first or second ends.

According to another aspect, the fastener is a spike assembly for being inserted into the surface.

According to another aspect, the spike assembly is a ring and a spike for being driven into the surface and securing each of the at least one bands to the surface.

According to another aspect, the connectors are mutually engageable clips.

According to another aspect, the length of the strap is adjustable.

According to another aspect, an ornamental display assembly for being attached to a structure extending from a surface is provided. The ornamental display assembly includes a strap having first and second connectors on respective ends thereof and is configured to form a loop for being looped around and attached to the structure. A sleeve is carried by the strap and defines at least one aperture and at least one ornamental band having a portion received in the sleeve and a portion extending from the sleeve having a fastener on and end thereof for being fastened to the surface. Each ornamental band of the at least one ornamental bands extends through a respective aperture of the at least one aperture.

According to another aspect, an ornamental display assembly is provided for being attached to a structure extending from a surface. The ornamental display assembly includes a strap having first and second connectors on respective ends thereof and is configured to form a loop for being looped around and attached to the structure. A sleeve is carried by the strap and defines a plurality of generally equally spaced-apart apertures. A plurality of ornamental bands is provided and each ornamental band of the plurality of ornamental bands has a portion received in the sleeve through a respective aperture of the plurality of apertures and a portion extending from the sleeve that has a fastener on and end thereof for being fastened to the surface.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Further, the claimed subject matter is not limited to implementations that solve any or all disadvantages noted in any part of this disclosure.

BRIEF DESCRIPTION OF THE DRAWINGS

The foregoing summary, as well as the following detailed description of preferred embodiments, is better understood when read in conjunction with the appended drawings. For the purposes of illustration, there is shown in the drawings exemplary embodiments; however, the presently disclosed subject matter is not limited to the specific methods and instrumentalities disclosed. In the drawings.

DETAILED DESCRIPTION

The presently disclosed subject matter now will be described more fully hereinafter with reference to the accompanying drawings, in which some, but not all embodiments are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

Figure 1:
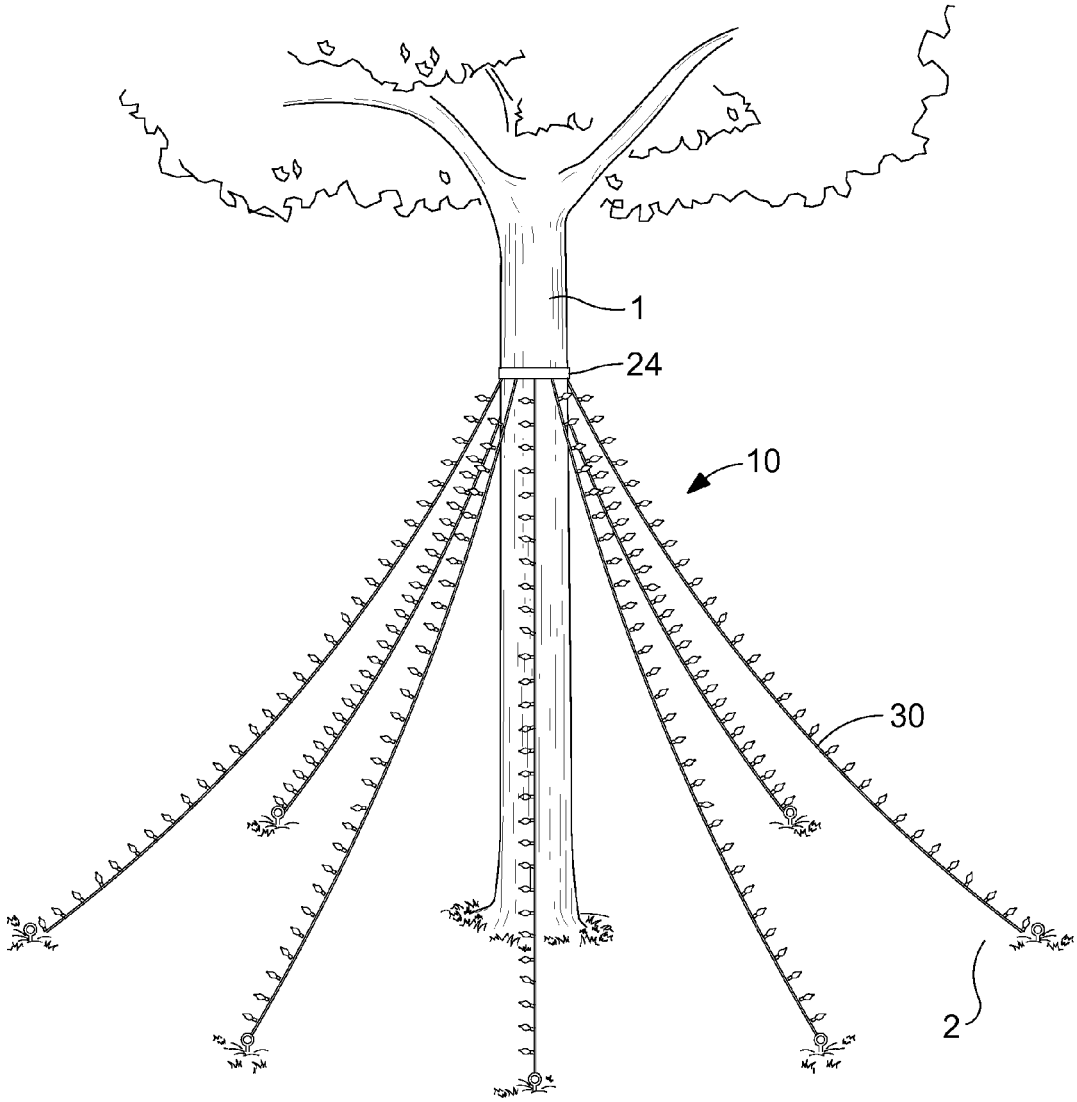
FIG. 1 is a front perspective view of an ornamental display assembly installed upon a proximal structure according to one embodiment of the presently disclosed subject matter.

FIG. 1 illustrates an ornamental display assembly that is generally designated as 10 throughout the drawings. As shown in FIG. 1, the ornamental display assembly 10 is configured to attach to a structure 1 by being looped around and secured to the structure 1. The ornamental display assembly 10 generally includes a sleeve 26 and at least one ornamental band 30 that extends to the surface 2. The sleeve 12 may be made out of nylon, synthetic polymers, or any other suitable material and is provided for housing portions of each of the ornamental bands 30. As shown in FIG. 1, structure 1 may be a tree and surface 2 may be the surrounding ground surface, while in other embodiments, structure 1 may be any elongate member and surface 2 may be any proximal surface.

Figure 2:
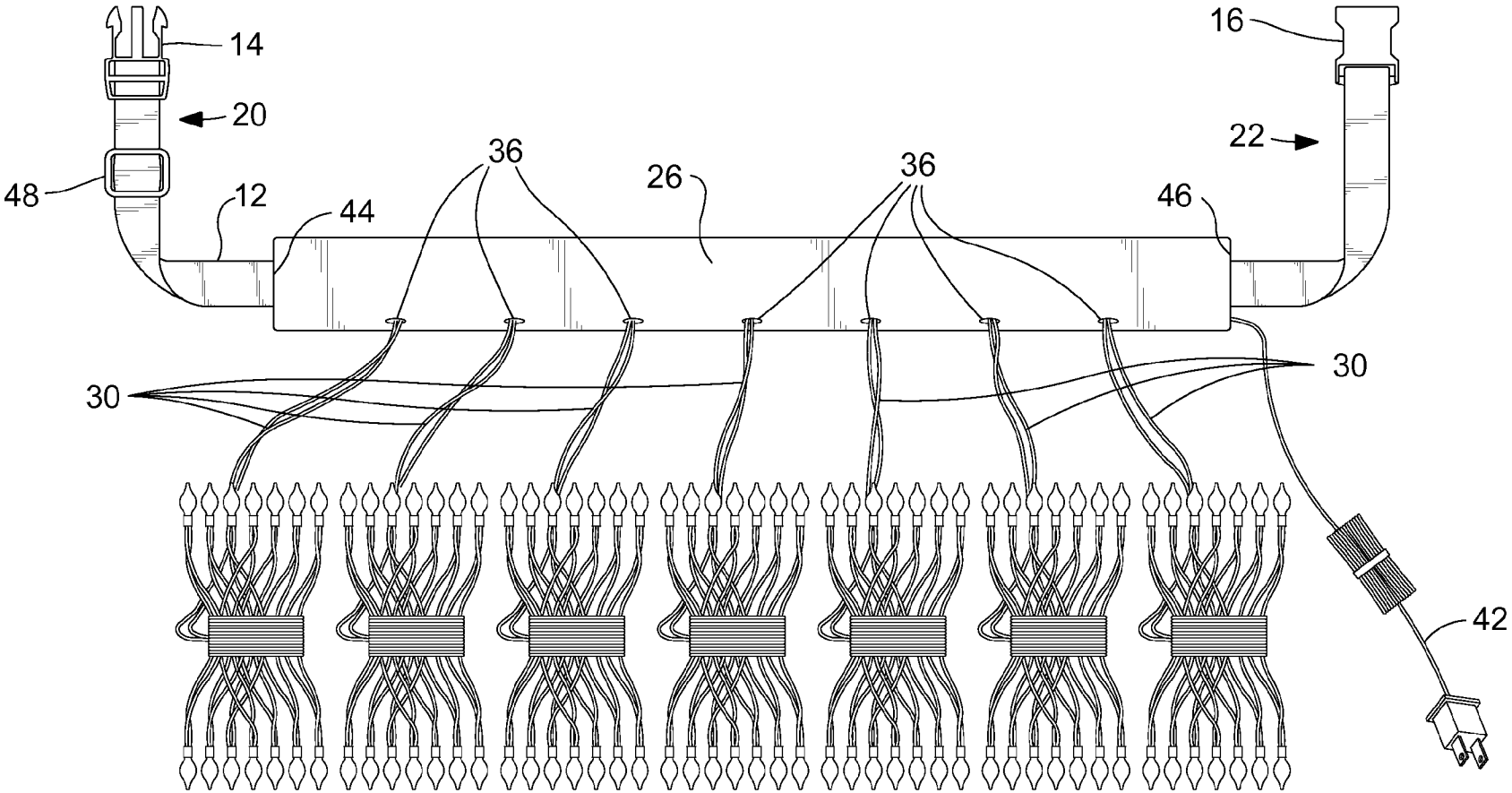
FIG. 2 is a front view of an ornamental display assembly according to one embodiment of the presently disclosed subject matter.

FIG. 2 illustrates a strap 12 having first and second connectors 14, 16 on respective ends 20, 22 thereof. The sleeve 26 is carried by the strap 12 and has first 44 and second 46 ends with a volume defined therebetween. The sleeve 26 may be attached to the strap 12 by a plurality of stitching, an adhesive fastener, a buckle, or any other suitable fastener. In other embodiments, the sleeve 26 is slideably carried by the strap 12 and is not fixedly secured thereto. The strap 12 has a slider 48 for adjusting the length of the strap 12. Each band of the at least one ornamental band 30 has a portion received in the volume of the sleeve 26 and a portion extending from the sleeve 26. If the ornamental display assembly 10 requires power, a power cord 42 for supplying power may be provided and is in electrical communication with the ornamental bands 30. At least one aperture 36 is defined in the sleeve 26 for allowing egress of each of the at least one ornamental bands 30 such that the bands 30 may be slideably received within sleeve 26. In some embodiments, each respective aperture 36 may be equally spaced-apart from each successive aperture 36.

Figure 3:
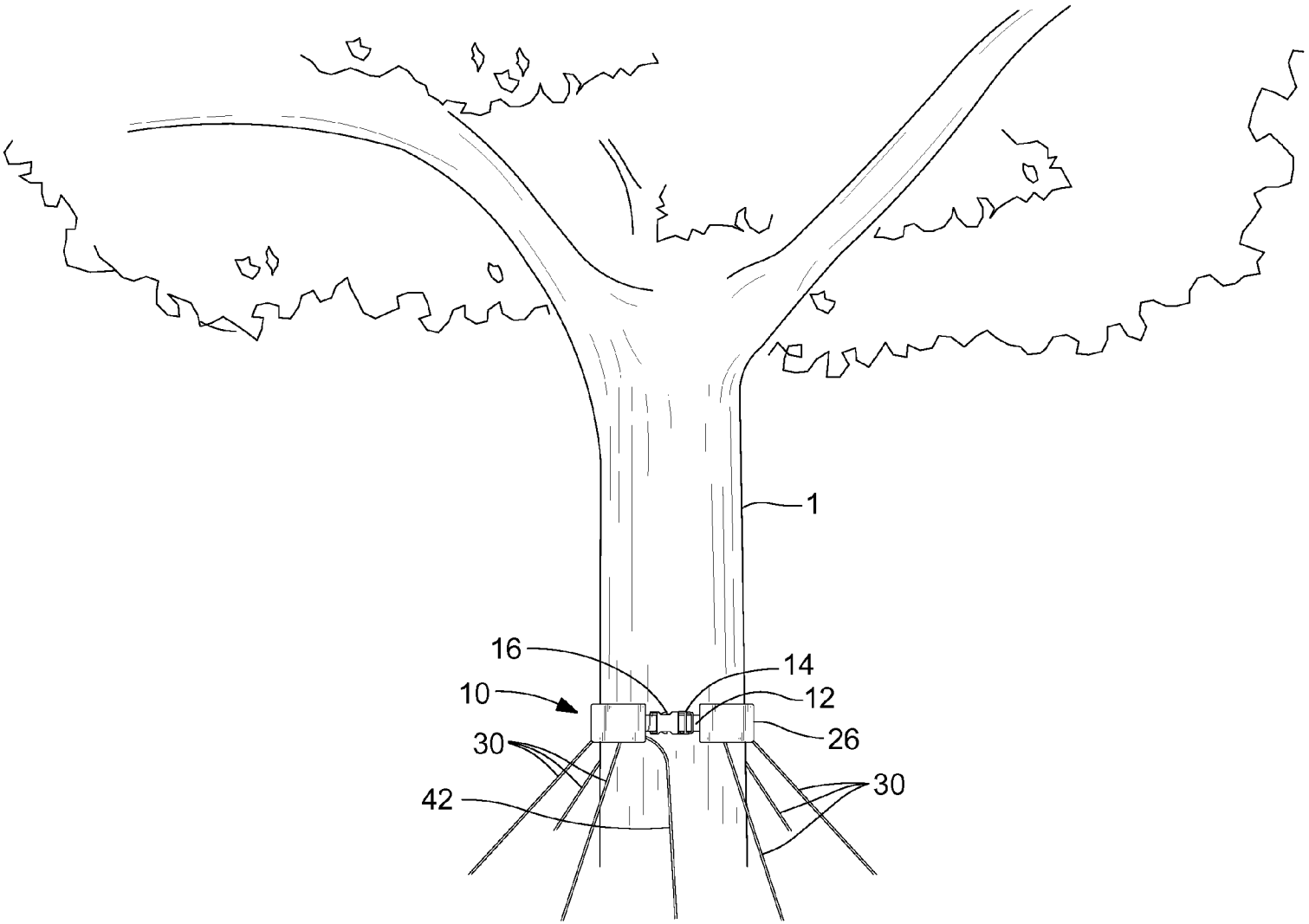
FIG. 3 is a front perspective view of an ornamental display assembly installed on the structure according to one embodiment of the presently disclosed subject matter.

FIG. 3 illustrates the ornamental display assembly 10 installed on the structure 1 in an enlarged rear view of that which is illustrated in FIG. 1. As illustrated in FIG. 3, the ornamental display assembly 10 is installed on the structure 1 by placing the strap 12 around a diameter of the structure 1 and engaging the first and second connectors 14, 16. The length of strap 12 may be varied by sliding slider 48 to fit varying size structures.

Figure 4:
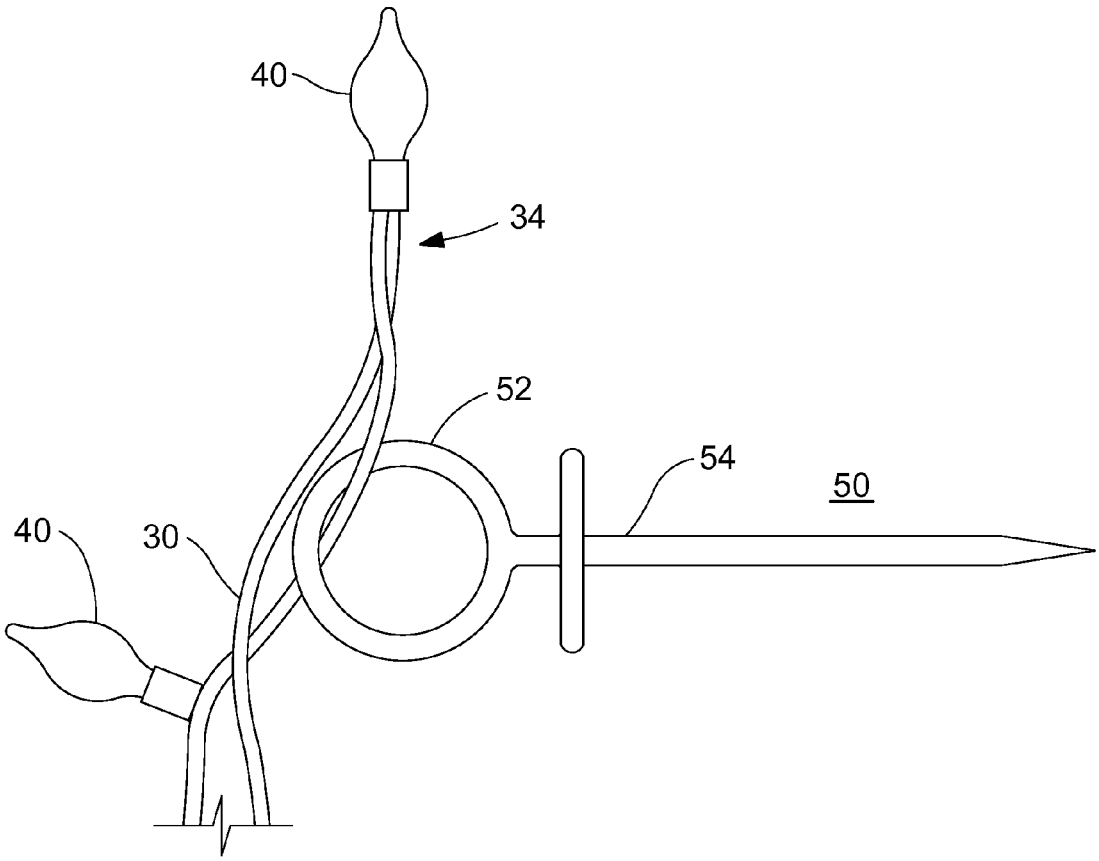
FIG. 4 is a front view of an end of an ornamental band of the ornamental display assembly according to another embodiment of the presently disclosed subject matter.

The ornamental band 30 is illustrated in FIG. 4 having a plurality of lights 40 affixed thereto according to one embodiment of the disclosed subject matter. Each ornamental band 30 includes a fastener 50 on an end 34 thereof for securing the band 30 to the proximal surface 2. In one embodiment, the fastener 50 may be a spike assembly having a spike 54 and a ring 52 in engagement therewith for receiving a portion of the end 34 of the band 30. The spike 54 is provided for being inserted into the surface 2, and may be driven into the surface 2 by striking spike 54 with a hammer or other tool.

Figure 5:
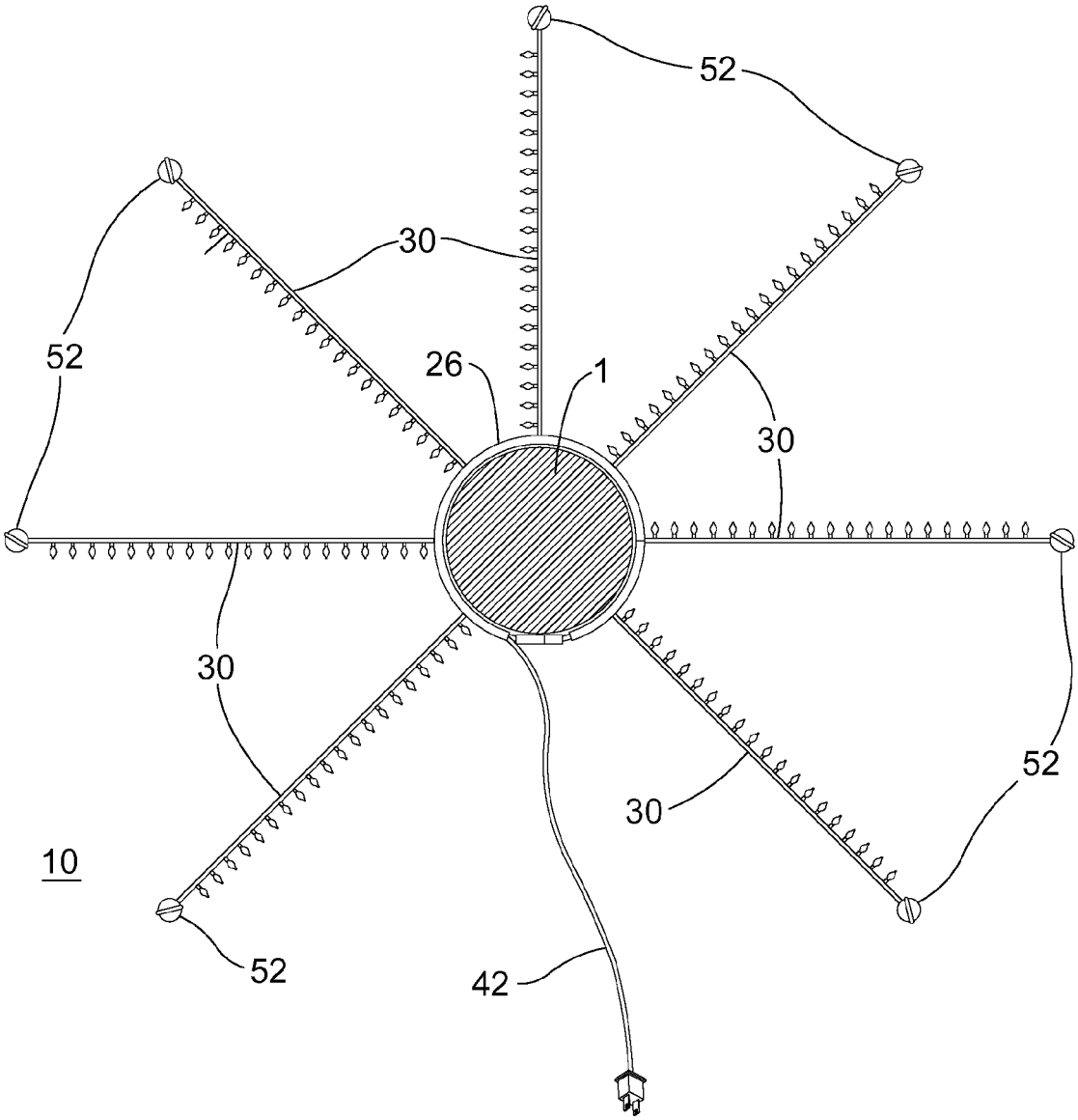
FIG. 5 is a cross-sectional top view of the ornamental display assembly installed on the structure according to another embodiment of the presently disclosed subject matter.

FIG. 5 illustrates an alternate embodiment of the ornamental display assembly 10. As shown in FIG. 5, the ornamental display assembly 10 is configured to attach to a structure 1 by being looped around and secured to the structure 1 by tightening the strap 12 through sliding slider 48. As illustrated in FIG. 4, the ornamental display assembly 10 is configured such that the bands 30 and power cord 42 form a generally symmetric overhead view. In this manner, the power cord 42 could also have lights 40 in communication therewith such that the power cord 42 resembles each of the ornamental bands 30. In another embodiment, sleeve 24 may include apertures that are closely spaced-apart and may include more apertures 36 than bands 30 such that the spacing of bands 30 may be altered by extending bands 30 through a selected aperture or series of apertures in order to provide for a generally symmetric overhead view and accommodate structures of varying diameters. In other embodiments, two ornamental display assemblies 10 could be connected to each other to form a total assembly having a greater total length for attaching to structures having larger diameters.

Figure 6:
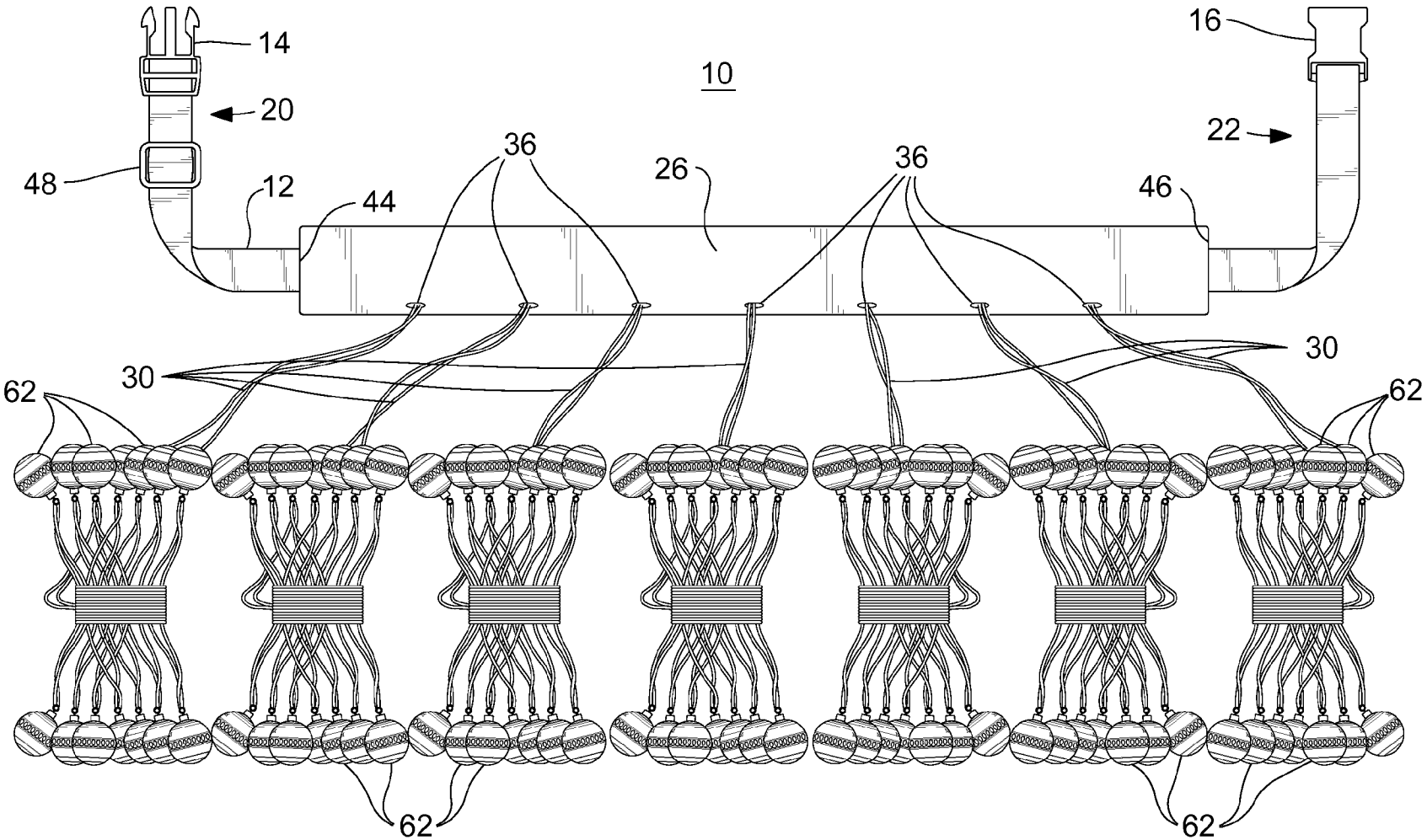
FIG. 6 is front view of an ornamental display assembly according to another embodiment of the presently disclosed subject matter.

FIG. 6 illustrates an alternate embodiment of the ornamental display assembly 10. This embodiment includes many features shown in the embodiment illustrated in FIG. 2, however, in this embodiment, the at least one ornamental bands 30 carry festive ornaments 62 as opposed to a plurality of lights 40.

While the embodiments have been described in connection with the preferred embodiments of the various figures, it is to be understood that other similar embodiments may be used or modifications and additions may be made to the described embodiment for performing the same function without deviating therefrom. Therefore, the disclosed embodiments should not be limited to any single embodiment, but rather should be construed in breadth and scope in accordance with the appended claims.

What is claimed is:

1. An ornamental display assembly for being attached to a structure extending from a surface, the ornamental display assembly comprising:

a strap having first and second connectors on respective ends thereof and configured to form a loop for being looped around and attached to the structure;

a sleeve carried by the strap; and at least one ornamental band having a portion extending from the sleeve and a fastener on an end thereof for being fastened to the surface.

2. The ornamental display assembly according to claim 1, wherein the strap is at least partially received within the sleeve.

3. The ornamental display assembly according to claim 1, wherein the sleeve has at least one aperture for allowing egress of each of the at least one ornamental bands.

4. The ornamental display assembly according to claim 3, wherein at least one aperture includes at least three apertures, and wherein each of the at least three apertures is equally spaced-apart.

5. The ornamental display assembly according to claim 1, wherein the ornamental band is a strand of lights.

6. The ornamental display assembly according to claim 5, further including a power cord for supplying power to the strand of lights.

7. The ornamental display assembly according to claim 6, wherein the sleeve has first and second ends and further wherein the power cord is received in a selected one of the first or second ends.

8. The ornamental display assembly according to claim 1, wherein the fastener is a spike assembly for being inserted into the surface.

9. The ornamental display assembly according to claim 8, wherein the spike assembly is a ring and a spike for being driven into the surface and securing each of the at least one bands to the surface.

10. The ornamental display assembly according to claim 1, wherein the connectors are mutually engageable clips.

11. The ornamental display assembly according to claim 1, wherein the length of the strap is adjustable.

12. An ornamental display assembly for being attached to a structure extending from a surface, the ornamental display assembly comprising:

a strap having first and second connectors on respective ends thereof and configured to form a loop for being looped around and attached to the structure;

a sleeve carried by the strap and defining at least one aperture; and at least one ornamental band having a portion received in the sleeve and a portion extending from the sleeve that has a fastener on an end thereof for being fastened to the surface, wherein each ornamental band of the at least one ornamental bands extends through a respective aperture of the at least one aperture.

13. The ornamental display assembly according to claim 12, wherein the strap is at least partially received within the sleeve.

14. The ornamental display assembly according to claim 12, wherein the at least one aperture includes at least three apertures, and wherein each of the at least three apertures is equally spaced-apart.

15. The ornamental display assembly according to claim 12, wherein the ornamental band is a strand of lights.

16. The ornamental display assembly according to claim 12, further including a power cord for supplying power to the strand of lights.

17. The ornamental display assembly according to claim 16, wherein the sleeve has first and second ends and further wherein the power cord is received in a selected one of the first or second ends.

18. An ornamental display assembly for being attached to a structure extending from a surface, the ornamental display assembly comprising:

a strap having first and second connectors on respective ends thereof and configured to form a loop for being looped around and attached to the structure;

a sleeve carried by the strap and defining a plurality of generally equally spaced-apart apertures; and a plurality of ornamental bands, each ornamental band of the plurality of ornamental bands having a portion received in the sleeve through a respective aperture of the plurality of apertures and a portion extending from the sleeve that has a fastener on and end thereof for being fastened to the surface.

* * * * *